US006332301B1

(12) United States Patent
Goldzak

(10) Patent No.: US 6,332,301 B1
(45) Date of Patent: Dec. 25, 2001

(54) METAL BEAM STRUCTURE AND BUILDING CONSTRUCTION INCLUDING SAME

(76) Inventor: Jacob Goldzak, 19 Hashaked St., 26 273 Kiryat Haim (IL)

( * ) Notice: Subject to any disclaimer, the term of this patent is extended or adjusted under 35 U.S.C. 154(b) by 0 days.

(21) Appl. No.: 09/453,097

(22) Filed: Dec. 2, 1999

(51) Int. Cl.[7] ..... E04C 3/30

(52) U.S. Cl. ..... 52/729.2; 52/729.1; 52/223.12; 52/223.8; 52/223.13; 52/223.1

(58) Field of Search ..... 52/729.2, 223.8, 52/223.13, 223.1, 729.1, 733.2, 731.9

(56) References Cited

U.S. PATENT DOCUMENTS 2,844,023 * 7/1958 Maiwurm ..... 72/61
3,487,518 * 1/1970 Hopfeld ..... 29/155
3,753,326 * 8/1973 Kaufman, Sr. ..... 52/731
3,913,290 * 10/1975 Billing et al. ..... 52/347
4,144,686 3/1979 Gold .
5,313,749 * 5/1994 Conner ..... 52/223.12
5,511,355 * 4/1996 Dingler ..... 52/729.5
5,704,181 1/1998 Fisher et al. .
5,848,512 * 12/1998 Conn ..... 52/729.1

* cited by examiner

*Primary Examiner*—Beth A. Stephan
*Assistant Examiner*—Patrick J. Chavez
(74) *Attorney, Agent, or Firm*—Benjamin J. Barish

(57) ABSTRACT

A metal beam includes a top flange; a bottom flange; and an intermediate web joining together the top flange and the bottom flange. The bottom flange includes an upper deck and a lower deck joined at their inner sides to the intermediate web in parallel spaced relation to each other to form a double-deck structure. The space between the upper and lower decks is occupied by tensioning elements embedded in concrete for prestressing the beam. The top flange is of smaller width but of substantially greater thickness than the bottom flange lower deck. In one described embodiment, the intermediate web is of a single wall construction; and in a second described embodiment, it is of a double-wall construction and also receives tensioning elements and concrete for prestressing the beam. Also described is a building structure in which the metal beams are used for supporting horizontal floor panels.

20 Claims, 5 Drawing Sheets

METAL BEAM STRUCTURE AND BUILDING CONSTRUCTION INCLUDING SAME

FIELD AND BACKGROUND OF THE INVENTION

The present invention relates to metal beam structures, particularly steel beams, and also to building constructions including such metal beams.

A particular type of metal beam widely used in the construction of buildings, bridges, and other structures, includes a top flange, a bottom flange, and an intermediate web joining together the two flanges. When such a beam is loaded, the top flange is placed under compression, and the bottom flange is placed under tension. Many techniques have been devised for increasing the load-carrying capacity of the beam, e.g., by prestressing the bottom flange in compression to reduce the bending of the beam under load. Examples of various techniques for increasing the load-carrying capacity of the beams are described in U.S. Pat. Nos. 4,144,686, 5,313,749 and 5,704,181.

OBJECTS AND BRIEF SUMMARY OF THE INVENTION

An object of the present invention is to provide a metal beam having a novel construction to increase its load-carrying capacity and/or to reduce the height of the beam as compared to a conventional beam construction for the same load-carrying capacity. Another object of the invention is to provide a building structure constructed with a plurality of such beams.

According to one aspect of the present invention, there is provided a metal beam, comprising: a top flange; a bottom flange; and an intermediate web joining together the top flange and the bottom flange. The bottom flange includes an upper deck and a lower deck joined to the intermediate web and extending in parallel spaced relation to each other. The web extends perpendicularly between, and is joined to, both the upper deck and the lower deck of the bottom flange. The lower deck extends for the length of the web. The metal beam further comprises a pair of transverse members fixed to the lower deck at its opposite ends; and a plurality of tensioning elements extending between the upper and lower decks and anchored to the transverse members to pre-stress the lower deck of the bottom flange, and thereby, to form a double-deck metal beam structure imparting to the beam a high resistance to deformation under load.

According to some described preferred embodiments, the transverse members to which the ends of the tensioning elements are anchored are fixed between the upper and lower decks at the opposite ends of the bottom flange on the opposite sides of the web.

According to another described preferred embodiment, the transverse members to which the ends of the tensioning elements are anchored are fixed between the lower deck and an end structure secured to the intermediate web and the lowered deck of the bottom flange at each of the opposite ends of the bottom flange on the opposite sides of the web.

In all the described embodiments, the space between the upper and lower decks is filled with concrete embedding the tensioning elements.

According to another aspect of the present invention, there is provided a metal beam, comprising a top flange; a bottom flange; and an intermediate web joining together the top flange and bottom flange; the bottom flange including an upper deck and a lower deck extending in parallel spaced relation to each other to form a double-deck structure; the lower deck of the bottom flange being of greater thickness than the upper deck of the bottom flange.

According to one preferred embodiment described below, the intermediate web is of a single wall construction; and according to a second described embodiment, it is of a double-wall construction.

According to another aspect of the present invention, therefore, there is provided a metal beam, comprising: a top flange; a bottom flange; and an intermediate web joining together the top and bottom flanges; the intermediate web being of a double-wall construction defined by parallel spaced walls and including tensioning elements between the spaced walls for prestressing the beam; the space between the parallel spaced walls of the intermediate web being filled with concrete embedding the tensioning elements.

According to a further aspect of the present invention, there is provided a building structure comprising a plurality of metal beams (e.g., steel beams) each constructed as described above; and a plurality of horizontal floor panels supported on the bottom flange upper deck on each of the opposite sides of a pair of horizontal metal beams and joined by cement thereto and to their intermediate webs.

In the described preferred embodiments, the horizontal floor panels are of a thickness equal to the distance between the upper face of the top flange and the upper face of the bottom flange upper deck.

The foregoing features in the construction of the metal beam provide a number of important advantages which are particularly important when the beams are used in building structures of multiple stories. Thus, the above described beam structure provides a relatively high load-carrying capacity for the weight and height of the beam. In addition, making the top flange narrower in width, but greater in thickness, than the bottom flange lower deck enables the floor panels to be of a thickness such that their upper surfaces are flush with the upper surface of the top flange, thereby minimizing the overall thickness of the floor for given conditions of the particular building structure, including the span distance between the columns, the self load, the service load, the construction material used, etc. The distance between the upper and lower decks of the bottom flange, and/or between the two walls of the intermediate web when a double-wall construction is used, can be designed to accommodate the desired number of tensioning elements (e.g., cables) and concrete according to the requirements for any particular application.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENTS

Figure 1:
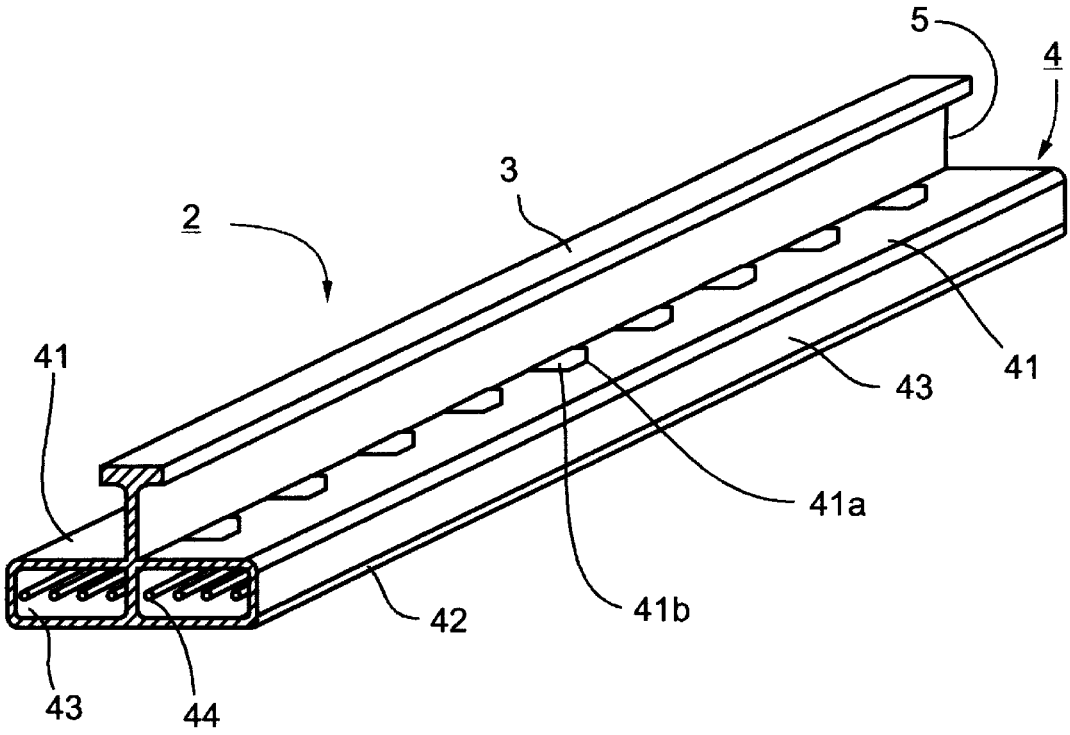
FIG. 1 is a three-dimensional view illustrating one form of metal beam constructed in accordance with the present invention.
Figure 4:
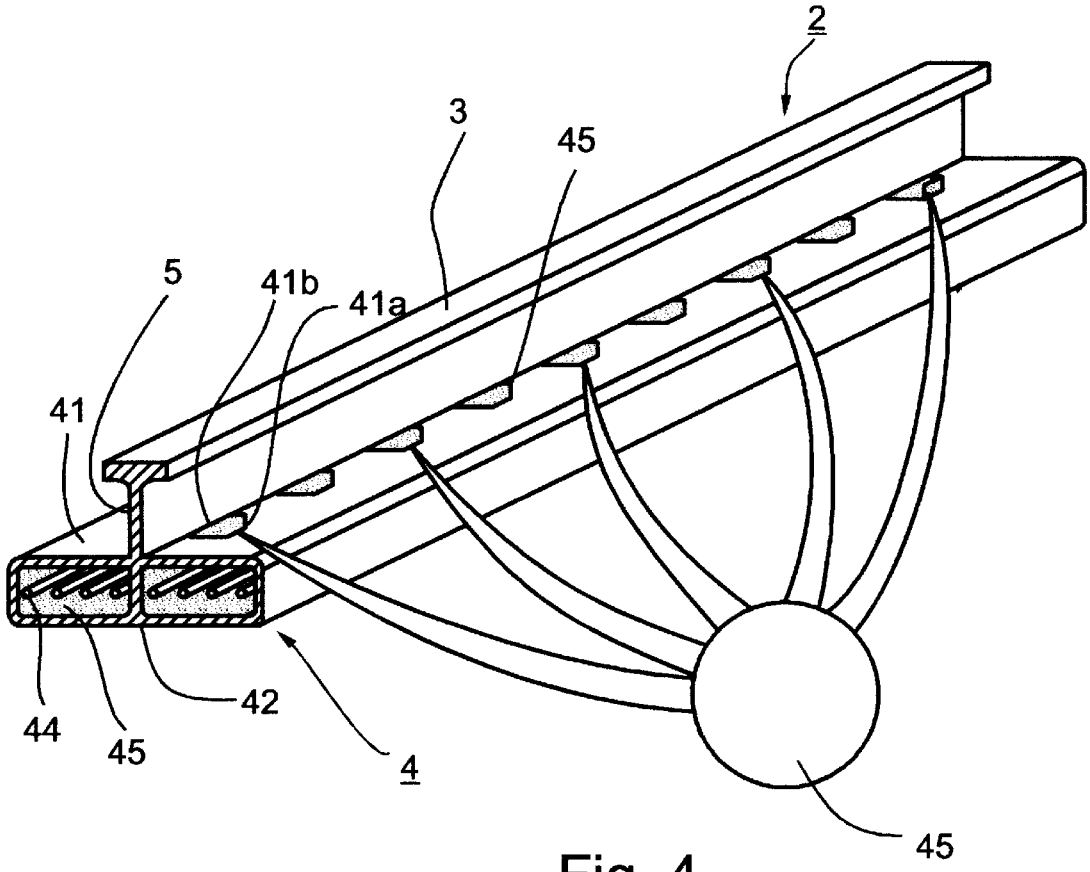
FIG. 4 illustrates the application of the concrete into the bottom flange of the beam of FIG. 1.

A metal beam, e.g., steel beam, constructed in accordance with the present invention is shown in FIG. 1 in its initial state, and in FIG. 4 in its pre-stressed state after it has been prestressed by tensioning elements (e.g., cables, rods, bars, etc.).

With respect to FIG. 1, the metal beam, therein generally designated 2, includes a top flange 3, a bottom flange generally designated 4, and an intermediate web 5 integrally formed with and joining together the top and bottom flanges 3, 4. The top flange 3 is of smaller width than the bottom flange 4, so that the illustrated beam is an asymmetric beam, sometimes called a disymmetric beam (e.g., see U.S. Pat. No. 5,704,181 cited above).

As also clearly seen in FIG. 1, the bottom flange 4 includes an upper section or deck 41, and a lower section or deck 42. As clearly seen in FIG. 3, the lower deck 42 is of substantially greater thickness than the upper deck 41. The two decks 41, 42 are integrally joined at their inner sides to the intermediate flange 5 in parallel spaced relation to each other and extend for the complete length of the top flange 3 and of the intermediate web 5. The two decks 41, 42 are integrally joined to each other at their outer sides by side wall 43, to define a double-deck box-like structure having a high resistance to deformation under load. The top flange 3 is substantially thicker, preferably several times thicker, than the lower deck 42 of the bottom flange 4.

Figure 2:
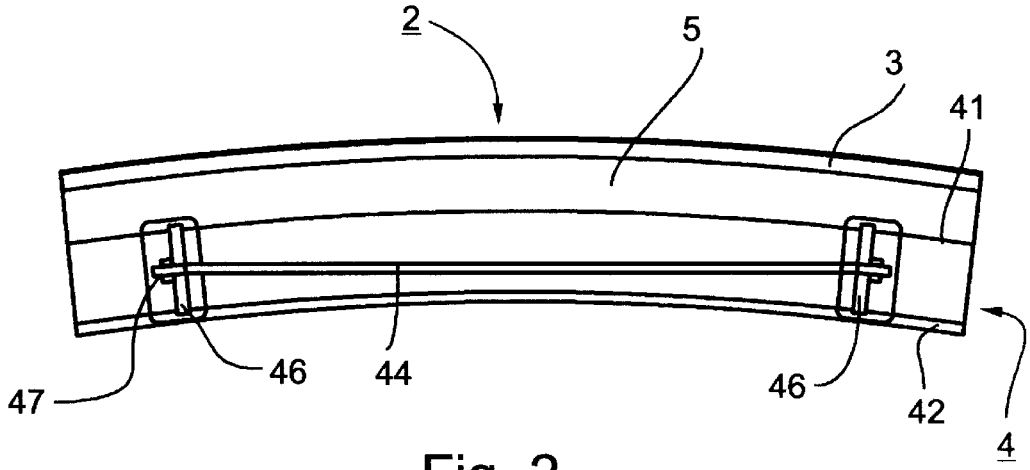
FIG. 2 illustrates the tensioning of the tensioning elements (e.g., cables, rods or bars) within the bottom flange of the beam of FIG. 1 for pre-stressing the beam.
Figure 3:
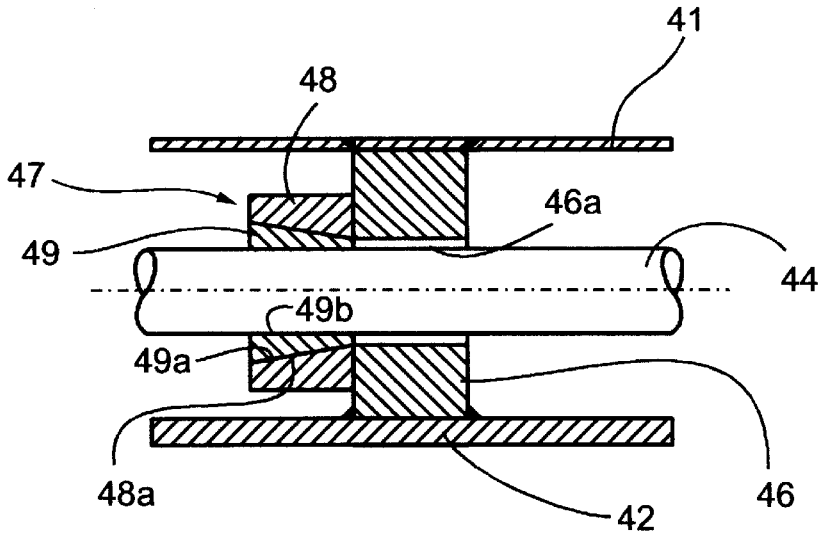
FIG. 3 is an enlarged view illustrating one example of one of the anchoring devices that may be used for tensioning the tensioning elements in FIG. 2.
Figure 5:
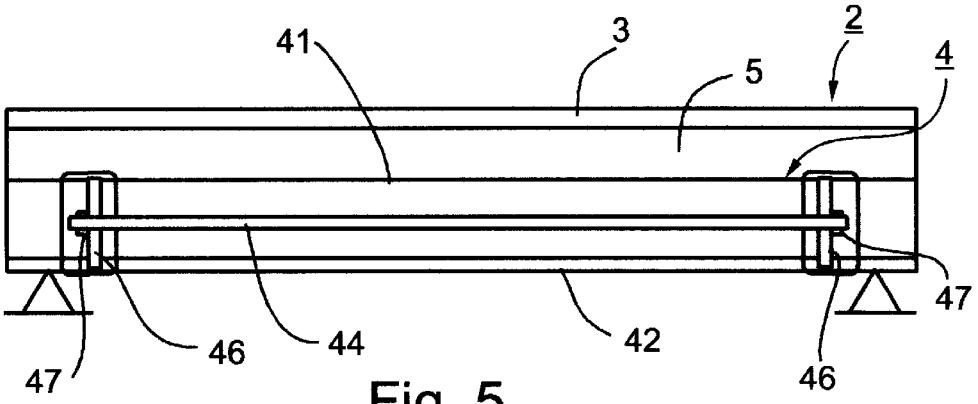
FIG. 5 illustrates the pre-stressed beam of FIG. 4 in its self-load condition without an external load.

The capability of the illustrated metal beam to resist deformation under load is substantially increased by prestressing the metal beam by means of the tensioning elements 44. Concrete 45 (FIG. 4) is introduced within the double-deck bottom flange 4 to embed the tensioning elements, and to protect them from fire and rust, as well as more securely holding them. FIGS. 2 and 3 illustrate the manner of pretensioning the tensioning elements 44; and FIGS. 4 and 5 illustrate the manner of introducing the concrete 45 after the tensioning elements have been pretensioned in order to pre-stress the metal beam.

As shown in FIG. 2, the opposite ends of the cables 44 within the double-deck bottom flange 4 are anchored to transverse members 46 at the opposite ends of the upper and lower decks 41, 42 of the bottom flange. In the described embodiment as shown in FIG. 3, the transverse members 46 are secured by welding to the opposite ends of the upper and lower decks 41, 42 and are provided with through-going openings 46*a* for receiving the ends of the respective tensioning elements 44. The ends of the tensioning elements are anchored to transverse members 46 by anchoring devices 47, each including an outer cylinder 48 having a conical inner surface 48*a*, and an inner wedge 49 having a complementarily-shaped conical outer surface 49*a* engaging the conical inner surface 48*a* of the cylinder 48. Wedge 49 may be a single element, or a plurality of separate elements, such as shown in the above-cited U.S. Pat. No. 4,144,686. The inner surface 49*b* of the wedge element (or elements) 49 is preferably formed with teeth to firmly grip the respective end of the tensioning elements 44. Other types of anchoring devices may be used particularly when different types of tensioning elements are applied.

The concrete 45 is introduced into the interior of the double-deck bottom flange 4 via slots 41*a* formed along the length of the upper deck 41 adjacent to its juncture with the intermediate flange 5. Slots 41*a* thus define a plurality of openings 41*b* spaced along the length of the bottom flange 4 on opposite sides of the intermediate web 5, for the introduction of the concrete 45 as shown in FIG. 4.

The illustrated metal beam is pre-stressed in the following manner:

After the tensioning elements 44 have been introduced into the interior of the double-deck bottom flange 4, their ends are secured by the anchor devices 47 to the transverse members 46 secured between the upper and lower decks 41, 42 at their opposite ends. The tensioning elements 44 are then tensioned as shown in FIG. 2. This may be done by loosening the anchoring devices 47, applying high tension forces to the opposite ends of the tensioning elements 44, and then tightening the anchoring devices 47 to secure the cable ends to the transverse members 46 and to bend the beam as shown in FIG. 2. Another method is by loosening the anchoring devices 47, applying a high upward load to the center of the beam while the opposite ends of the beam are held in place, and then tightening the anchoring devices 47.

Figure 6:
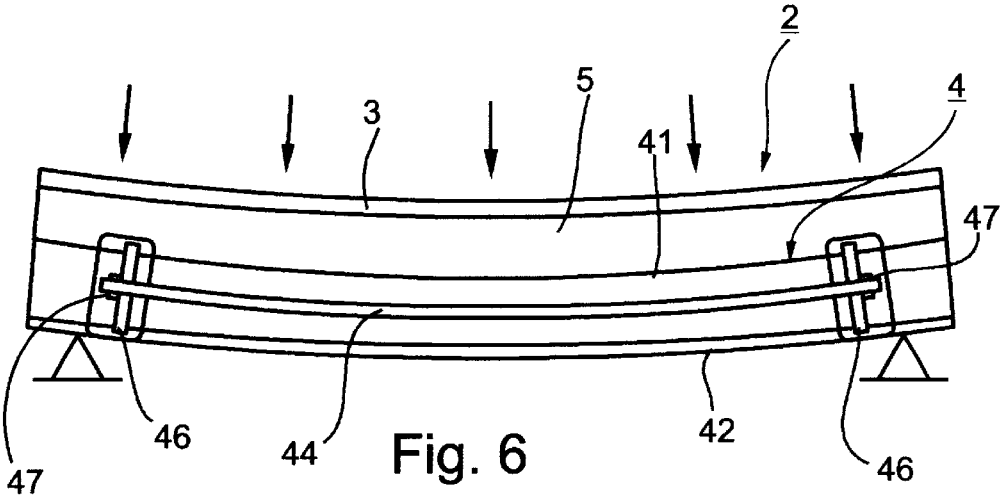
FIG. 6 illustrates the beam of FIG. 4 in a heavy loaded condition.

After the tensioning elements 44 have been thus tensioned, concrete is applied via the concrete inlets 41*b*, as shown in FIG. 4, to fill the complete interior of the double-deck bottom flange 4 and to embed the tensioned elements 44. The weight of the concrete tends to straighten the beam, as shown in FIG. 5. The result is a prestressed asymmetric beam capable of resisting very high loads for the respective weight and height of the beam. FIG. 6 illustrates the deformation of the beam under high load conditions.

Figure 7:
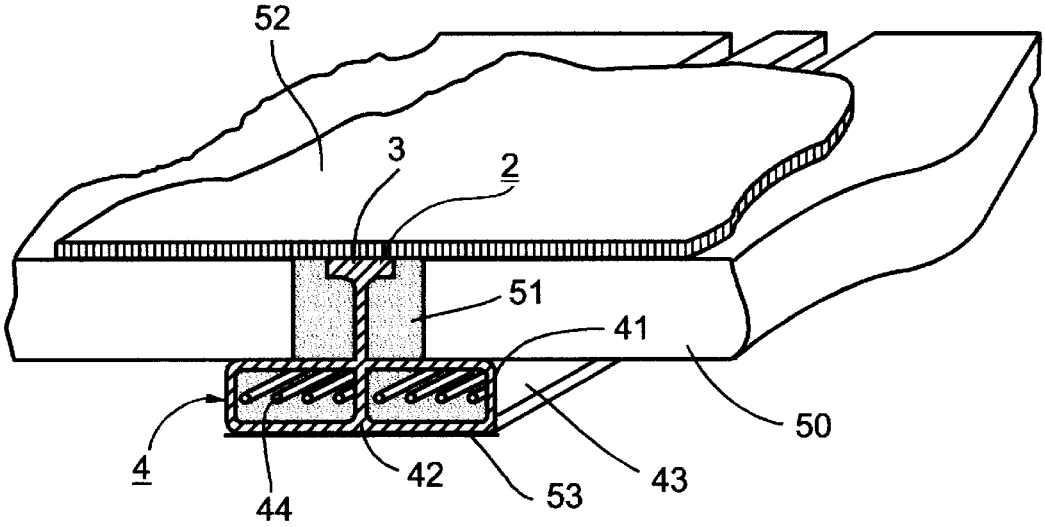
FIG. 7 illustrates the beam of FIG. 4 used in a building structure for supporting floor panels.
Figure 8:
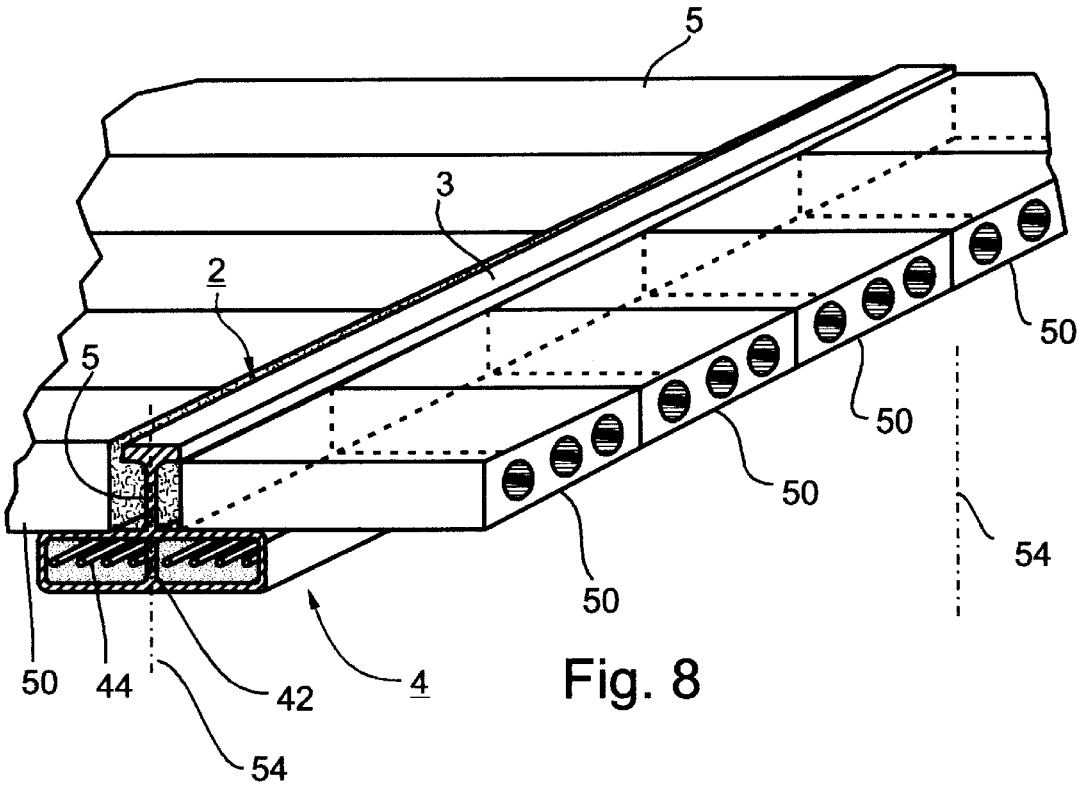
FIG. 8 illustrates the beam of FIG. 4 used in a building structure for supporting floor panels in the form of precast concrete slabs.
Figure 9:
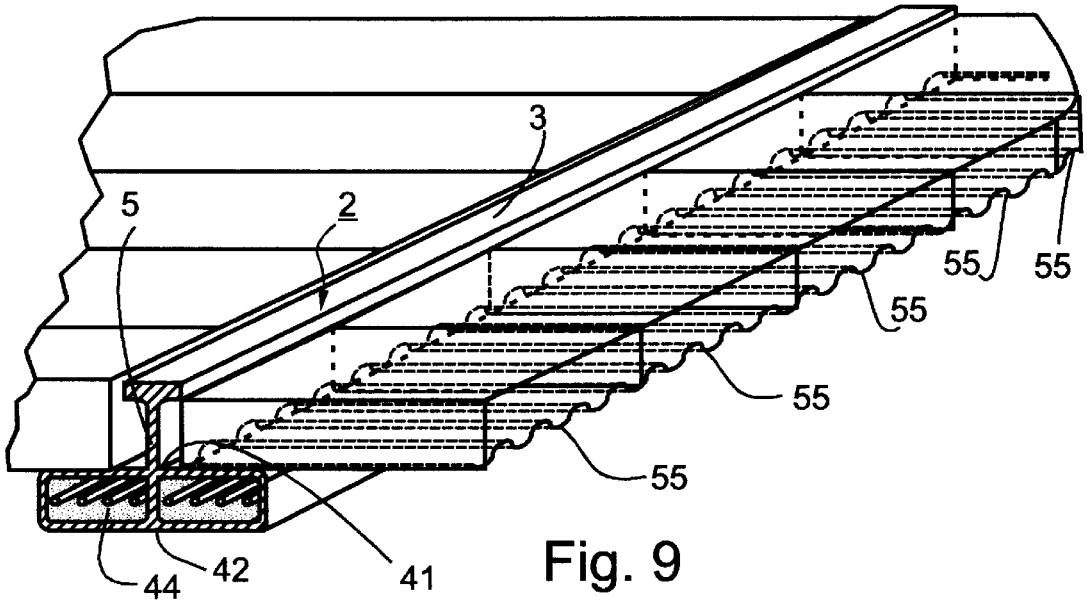
FIG. 9 illustrates the metal beams of FIG. 4 used in a building structure for supporting floor panels of the prefabricated steel deck type.

FIGS. 7–9 illustrate the use of such an asymmetric beam in building structures for mounting floor panels, generally designated 50. As shown in FIG. 7, the floor panels 50 are supported on the upper deck 41 of each of the opposite sides of a pair of horizontal metal beams 2, and are joined thereto by cement 51. Preferably, the horizontal floor panels 50 are of a thickness equal to the distance between the upper face of the top flange 3 and the upper face of the upper deck 41 of the bottom flange 4 and are spaced from the top flange and the intermediate web 5 to define a volume flush with the upper face of the top flange for receiving the cement 51. A topping layer 52 is applied over the upper faces of the floor panels 50, the top flanges 3 and the cement 51 joining the floor panels to the metal beams 2. The bottom faces of the lower decks 42 of the bottom flanges 4 are covered by fire protection material 53.

FIG. 8 illustrates a construction wherein the horizontal floor panels 50 are precast concrete slabs supported by the horizontal beams 2. Beams 2 may be supported by a plurality of vertical columns, schematically indicated at 54, or by girders, other main beams, other walls, etc. As further seen in FIG. 8, a plurality of the horizontal floor panels 50 are supported on the upper deck 41 of the bottom flange 4 on each of the opposite sides of a pair of the horizontal metal beams 2 and are joined by cement 51 to the upper decks and to the intermediate webs 5 of the beams.

FIG. 9 illustrates a construction wherein the horizontal floor panels are of the type of prefabricated steel decks, as shown at 55.

Figure 10:
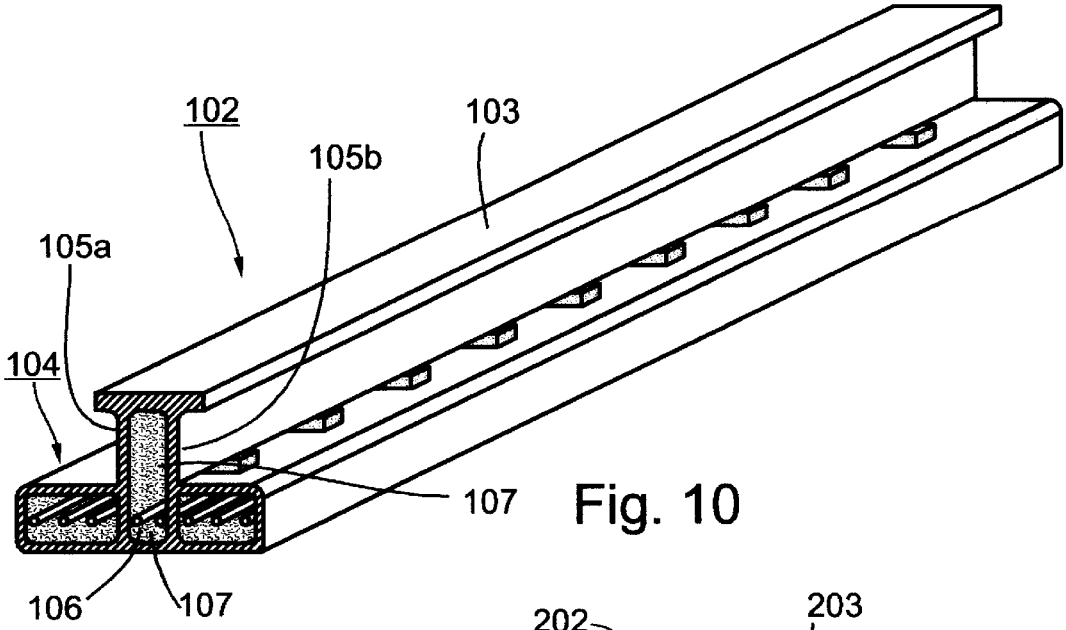
FIG. 10 is a view similar to that of FIG. 4 but illustrating another embodiment of the invention.

FIG. 10 illustrates a metal beam of a similar construction as described above, except that, instead of having an intermediate web of a single-wall construction, it has an intermediate web of a double-wall construction. Thus, the beam illustrated in FIG. 10, therein generally designated 102, also includes a top flange 103, and bottom flange 104, as described above, except that the intermediate web is of a double-wall construction defined by two parallel spaced walls 105*a*, 105*b*. The space between the two walls is occupied by tensioning elements 106 pretensioned in the same manner as described above and embedded in concrete 107 cast between the two walls 105*a*, 105*b* after tensioning of the elements 106. In this case, the concrete 107 is preferably introduced via the ends of the metal beam 102, rather than in slots formed along its length. In all other respects, the beam illustrated in FIG. 10 is constructed in the same manner as described above.

Figure 11:
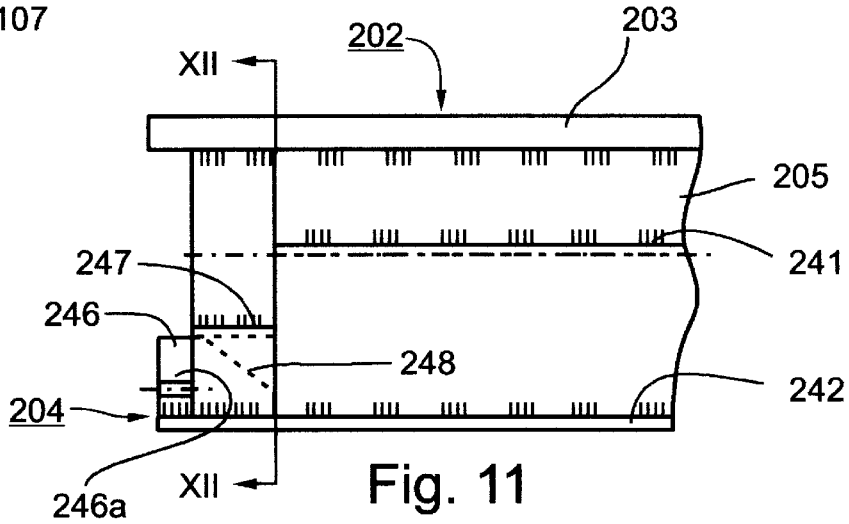
FIG. 11 is an elevational view illustrating an end structure that may be provided at each end of the beam for anchoring the tensioning elements in order to prestress the beam.

FIG. 11 illustrates the end structure of a metal beam that may be used for anchoring the tensioning elements where there is a relatively large spacing between the upper and lower decks of the bottom flange. Thus, as shown in FIG. 11, the beam, generally designated 202, also includes a narrow thick top flange 203, a bottom flange 204 joined by an intermediate web 205, with the bottom flange including an upper deck 241, a lower deck 242, side walls 243 and tensioning elements 244 within the double-deck structure for prestressing the beam. In this case, however, the transverse walls 246 at the opposite ends of the bottom flange do not extend for the complete distance between the upper and lower decks 241, 242, but rather extend only between the lower deck 242 and a plate 247 secured to the end of the lower deck 242 and parallel to it by a plurality of walls 248 extending perpendicularly between the lower deck 242 and the intermediate plate 247. Transverse walls 246, plates 247, and perpendicular walls 248 thus define an end structure secured to web 205 and the opposite ends of the lower deck 242, on each of the opposite sides of the web, for anchoring the tensioning elements in order to pre-stress the lower deck 242. As further shown in FIG. 11, transverse wall 246 is provided with an opening 246*a* for receiving the end of the respective tensioning element.

Figure 12:
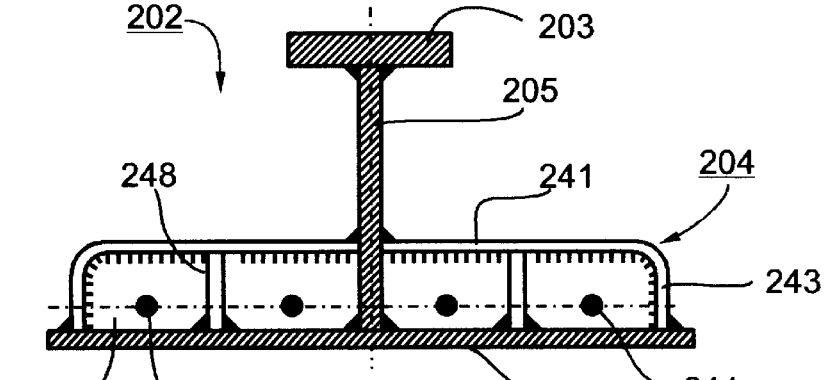
FIG. 12 is a sectional view illustrating a modification in the construction of the metal beam of FIG. 11.

FIG. 12 illustrates a similar construction except the transverse walls 246 for anchoring the tensioning elements, shown at 244, are secured between the lower deck 242 and the upper deck 241, instead of between the lower deck and the end structure defined by plates 247 and walls 248.

It will thus be seen that the above-described beams are characterized by having a relatively high load-carrying capacity for the weight and height of the beam which makes them particularly useful for multi-storied building structures. In addition, the preferred construction, wherein the top flange is of narrow width, enables the building structure to have floor panels of a thickness flush with the upper surfaces of the top flanges. Further, since a major surface area of the beam is covered by concrete, the cost of fire protection may be considerably reduced.

While the invention has been described with respect to several embodiments, it will be appreciated that there are set forth merely for purposes of example, and that many variations may be made. For example, as indicated above, other types of anchoring devices can be used for anchoring the tensioning elements. In addition, two or more rows of tensioning elements can be used within the double-deck bottom flange, and/or the double-wall intermediate web, depending on the particular application. Further, where it is desired to have relatively large distances between the two decks (41, 42) of the bottom flange double-deck structure, the transverse members 46, used for pretensioning the tensioning elements, could be fixed between the opposite ends of the beam by the described structures fixed at the ends, or at intermediate locations symmetrical to the beam center. In addition, the concrete 45 embedding the tensioning elements 44 in the bottom flange double-deck structure could be applied from the ends of the beam, similar to the manner concrete 107 is applied between the two walls 105*a*, 105*b* of the intermediate web in the FIG. 10 embodiment. Also, any type of floor panels may be used, e.g., plastic panels, steel gratings, etc. Still further, the double-wall construction for the intermediate flange may be used without the double-deck structure of the bottom flange. A further modification may be to form the intermediate web with a plurality of openings or holes in order to reduce its weight.

A building structure may also include beams of a conventional construction in combination with beams of the novel construction of the present invention.

Many other variations, modifications and applications of the invention will be apparent.

What is claimed is:

1. A metal beam, comprising: a top flange; a bottom flange; and an intermediate web joining together said top flange and said bottom flange; said bottom flange including an upper deck and a lower deck joined to said intermediate web and extending in parallel spaced relation to each other; said web extending perpendicularly between, and being joined to, both the upper deck and the lower deck of said bottom flange; said lower deck extending for the length of said web; said metal beam further comprising: a pair of transverse members fixed to said lower deck at its opposite ends; and a plurality of tensioning elements extending between said upper and lower decks and anchored to said transverse members to pre-stress the lower deck of the bottom flange, and thereby, to form a double-deck metal beam structure imparting to the beam a high resistance to deformation under load.

2. The metal beam according to claim 1, wherein said upper and lower decks of the bottom flange are joined together at their outer sides by an outer side wall.

3. The metal beam according to claim 1, wherein the lower deck of said bottom flange is of greater thickness than the upper deck of said bottom flange.

4. The metal beam according to claim 1, wherein said transverse members to which the ends of said tensioning elements are anchored are fixed between said upper and lower decks at the opposite ends of said bottom flange on the opposite sides of said web.

5. The metal beam according to claim 1, wherein said transverse members to which the ends of said tensioning elements are anchored are fixed between said lower deck and an end structure secured to said intermediate web and said lower deck of the bottom flange at each of the opposite ends of the bottom flange on the opposite sides of said web.

6. The metal beam according to claim 1, wherein the space between said upper and lower decks is filled with concrete embedding said tensioning elements.

7. The metal beam according to claim 6, wherein said upper deck is formed with a plurality of slots spaced along its length where joined to the intermediate web to define therewith inlet openings for introducing said concrete.

8. The metal beam according to claim 1, wherein said top flange is smaller in width but substantially greater in thickness than said bottom flange lower deck.

9. The metal beam according to claim 1, wherein said intermediate web is of a single wall construction.

10. The metal beam according to claim 1, wherein said intermediate web is of a double-wall construction defined by parallel spaced walls.

11. The metal beam according to claim 10, wherein the space between said parallel spaced walls of the intermediate web includes tensioning elements and is filled with concrete embedding said tensioning devices.

12. A metal beam, comprising: a top flange; a bottom flange; and an intermediate web joining together said top flange and bottom flange; said bottom flange including an upper deck and a lower deck extending in parallel spaced relation to each other to form a double-deck structure; said lower deck of the bottom flange being of greater thickness than the upper deck of said bottom flange.

13. The metal beam according to claim 12, wherein said top flange is of smaller width and greater thickness than said lower deck of the bottom flange.

14. The metal beam according to claim 12, wherein the space between said upper and lower decks is occupied by tensioning elements for pre-stressing the lower deck of the bottom flange; the ends of said tensioning elements being anchored to transverse members secured to said lower deck at its opposite ends on opposite sides of said intermediate web.

15. The metal beam according to claim 14, wherein the space between said upper and lower decks is filled with concrete embedding said tensioning elements.

16. A metal beam comprising: a top flange; a bottom flange; and an intermediate web joining together said top and bottom flanges; said intermediate web being of a double-wall construction defined by parallel spaced walls and including tensioning elements between the spaced walls for prestressing the beam; the space between said parallel spaced walls of the intermediate web being filled with concrete embedding said tensioning elements.

17. The metal beam according to claim 16, wherein said bottom flange includes an upper deck and a lower deck joined to said parallel spaced walls of the intermediate web in parallel spaced relation to each other and extending for the length of the top flange and intermediate web to form a double-deck structure.

18. The metal beam according to claim 17, wherein said top flange is of smaller width, but of substantially greater thickness, than said bottom flange lower deck.

19. A building structure comprising: a floor including a plurality of horizontal floor panels supported by a plurality of metal beams, each according to claim 1; said plurality of horizontal floor panels being supported on the bottom flange upper deck of each of the opposite sides of a pair of said metal beams and joined by cement thereto and to their intermediate webs.

20. The building structure according to claim 19, wherein said horizontal floor panels are of a thickness equal to the distance between the upper face of the top flange and the upper face of the bottom flange upper deck.

* * * * *